US012735227B2

(12) United States Patent
Lab

(10) Patent No.: US 12,735,227 B2
(45) Date of Patent: Sep. 15, 2026

(54) CUP STABILIZATION DEVICE

(71) Applicant: Anthony Lab, Norton, OH (US)

(72) Inventor: Anthony Lab, Norton, OH (US)

( * ) Notice: Subject to any disclaimer, the term of this patent is extended or adjusted under 35 U.S.C. 154(b) by 11 days.

(21) Appl. No.: 19/017,740

(22) Filed: Jan. 12, 2025

(65) Prior Publication Data

US 2026/0200639 A1 Jul. 16, 2026

(51) Int. Cl.
*B65D 25/24* (2006.01)
*A47G 23/02* (2006.01)
*B65D 25/28* (2006.01)

(52) U.S. Cl.
CPC ..... *B65D 25/24* (2013.01); *A47G 23/0216* (2013.01); *B65D 25/2811* (2013.01)

(58) Field of Classification Search
CPC ... A45F 3/16; A45G 23/0216; A45G 23/0316; A45G 2019/2294; A45G 2400/08; A45G 2400/086; A45B 91/10; A45B 91/16; A47J 47/16; B44G 3/14; B65D 1/0284; B65D 25/20; B65D 25/24; B65D 23/001; B65D 21/066; B65D 81/07; B65D 85/72
See application file for complete search history.

(56) References Cited

U.S. PATENT DOCUMENTS 872,498 A * 12/1907 Cleveland ..... A47B 23/046 248/157
4,760,987 A * 8/1988 Lan ..... A47G 23/03 248/346.11
5,217,193 A * 6/1993 Drucker ..... E04D 15/00 248/154
9,521,919 B1 * 12/2016 Reyes ..... A47G 29/093

* cited by examiner

*Primary Examiner* — Andrew T Kirsch
(74) *Attorney, Agent, or Firm* — Daniel M. Cohn

(57) ABSTRACT

A stabilization device that is adapted to contain a liquid is provided. The stabilization device includes a container, a circular base, a circular structure, four projections, and four cylindrical pillars. The circular base includes a central portion rotatable between 0 degrees and 45 degrees with respect to a center of the central portion. The central portion includes a torsion spring. The four cylindrical pillars are received in hollow cylinders. A compression spring in each of the hollow cylinders is engaged with a corresponding cylindrical pillar. The circular structure is mounted to the circular base by the central portion. The four projections extend out beyond an outer wall of the container. A top surface of the liquid in the container is maintained flat or parallel with respect to a surface on which the stabilization device is supported.

14 Claims, 7 Drawing Sheets

CUP STABILIZATION DEVICE

FIELD OF INVENTION

The present invention relates generally to a cup stabilization device and, more specifically, the present invention relates to a cup stabilization device that allows the cup to rest on an uneven surface without the contents of the cup spilling out.

BACKGROUND OF INVENTION

As is known, cups for drinking liquid are used wherever people vacation or play sports or otherwise enjoy themselves. The cups typically have a hand holder for ease of handling the cup. However, in many cases, the ground is not flat, and the cup which is typically sitting on its bottom surface is not level and the liquid has a tendency to spill out from the sides of the cup. One way to compensate for the uneven ground is to put a small piece of paper under one side of the cup. However, this is a temporary solution to the problem. Another solution is to spill enough liquid from the cup so that the upper surface of the liquid is generally parallel to the ground. It would be desirable to provide a system that adjusts the cup so that the upper surface of the liquid is generally parallel to the ground.

SUMMARY OF THE INVENTION

According to an embodiment of the present invention, there is disclosed a stabilization device incorporating a container that is adapted to contain a liquid, comprising the top surface of the liquid in the container is maintained flat or parallel with respect to the surface on which the stabilization device is supported. A circular base having a central portion that rotates between 0 degrees and 45 degrees with respect to a center of the central portion. The central portion includes a torsion spring. Four cylindrical pillars received in hollow cylinders. A compression spring in each of the cylinders engages the pillars. A circular structure which is mounted to the circular base by the central portion. Four projections extending out beyond an outer wall of the container engaging slits which are disposed along one side of each of the four cylindrical pillars.

BRIEF DESCRIPTION OF THE DRAWINGS

The structure, operation, and advantages of the present invention will become further apparent upon consideration of the following description taken in conjunction with Certain elements in some of the figures may be omitted, or illustrated not-to-scale, for illustrative clarity. The cross-sectional views may be in the form of slices, or near-sighted cross-sectional views, omitting certain background lines which would otherwise be visible in a true cross-sectional view, for illustrative clarity.

Often, similar elements may be referred to by similar numbers in various figures (Figures) of the drawing, in which case typically the last two significant digits may be the same, the most significant digit being the number of the drawing figure (Figure).

DETAILED DESCRIPTION OF THE PREFERRED EMBODIMENT

Figure 1:
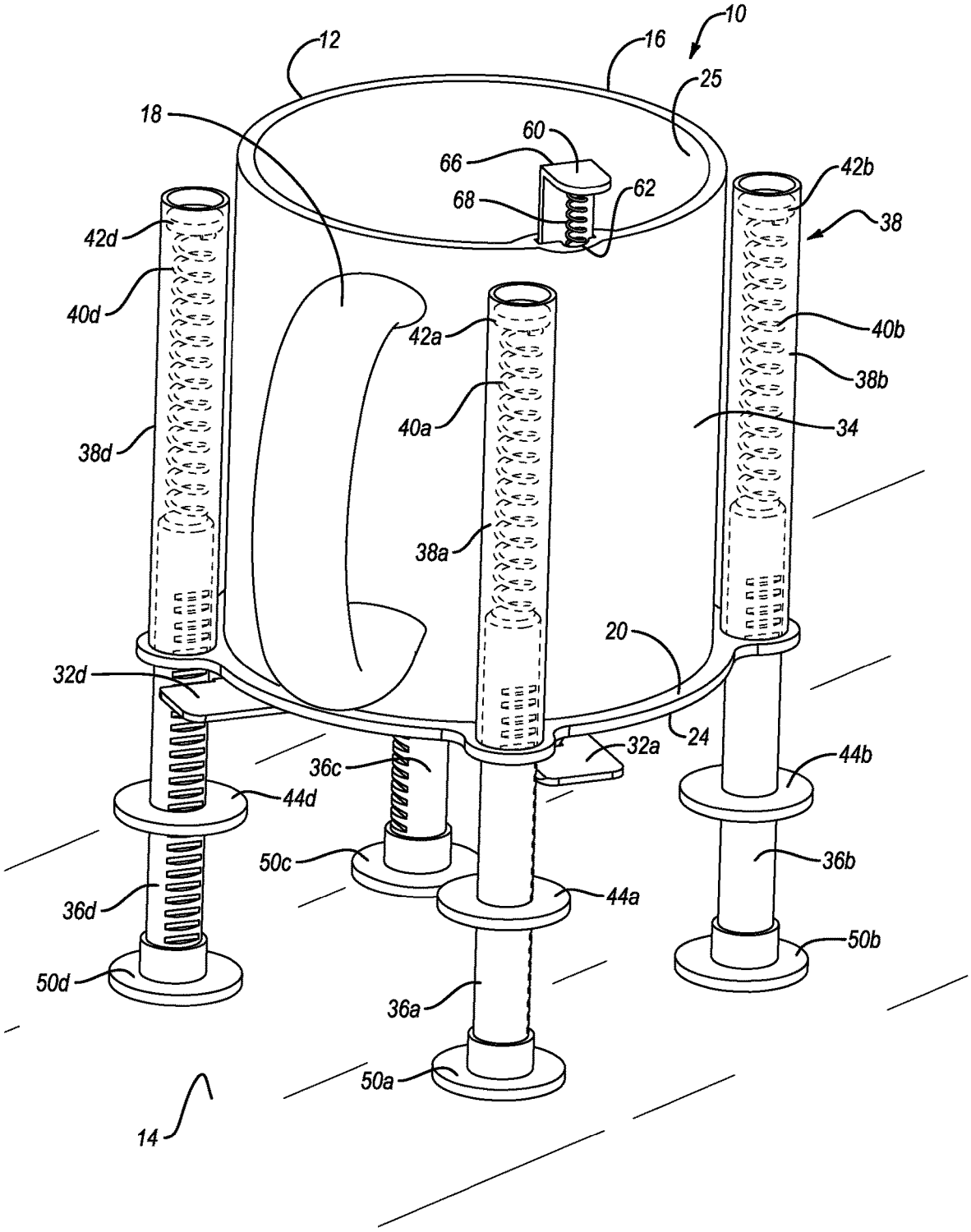
FIG. 1 is a left, three-dimensional view of a first embodiment of the cup stabilization device, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, both reference numerals and legends (labels, text descriptions) will be used to identify elements. If legends are provided, they are intended merely as an aid to the reader and should not in any way be interpreted as limiting.

In general terms, the present invention relates to a stabilization device 10 incorporating a container 12 that is adapted to contain a liquid. According to the invention, the top surface of the liquid in the container 12 can be maintained flat or parallel with respect to the surface 14, ie. the ground, on which the stabilization device 10 is supported. This is especially important when the ground 14 is not flat, as shown in FIG. 1. In that case, the container 12 will sit at an angle, causing the container to spill out from the top 16 of the container.

Figure 3:
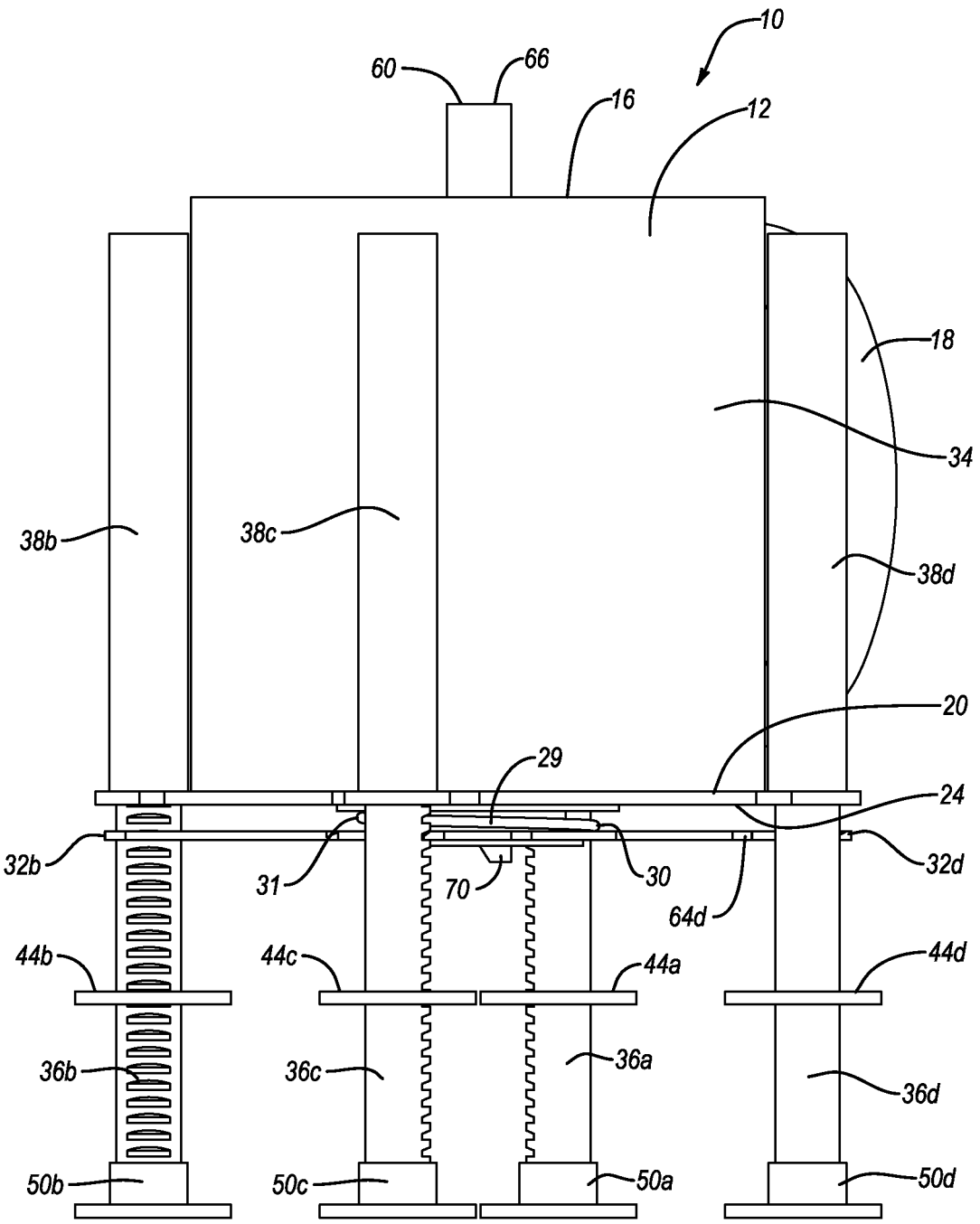
FIG. 3 is a right side, three-dimensional view of the first embodiment of the cup stabilization device, in accordance with the present invention.
Figure 4:
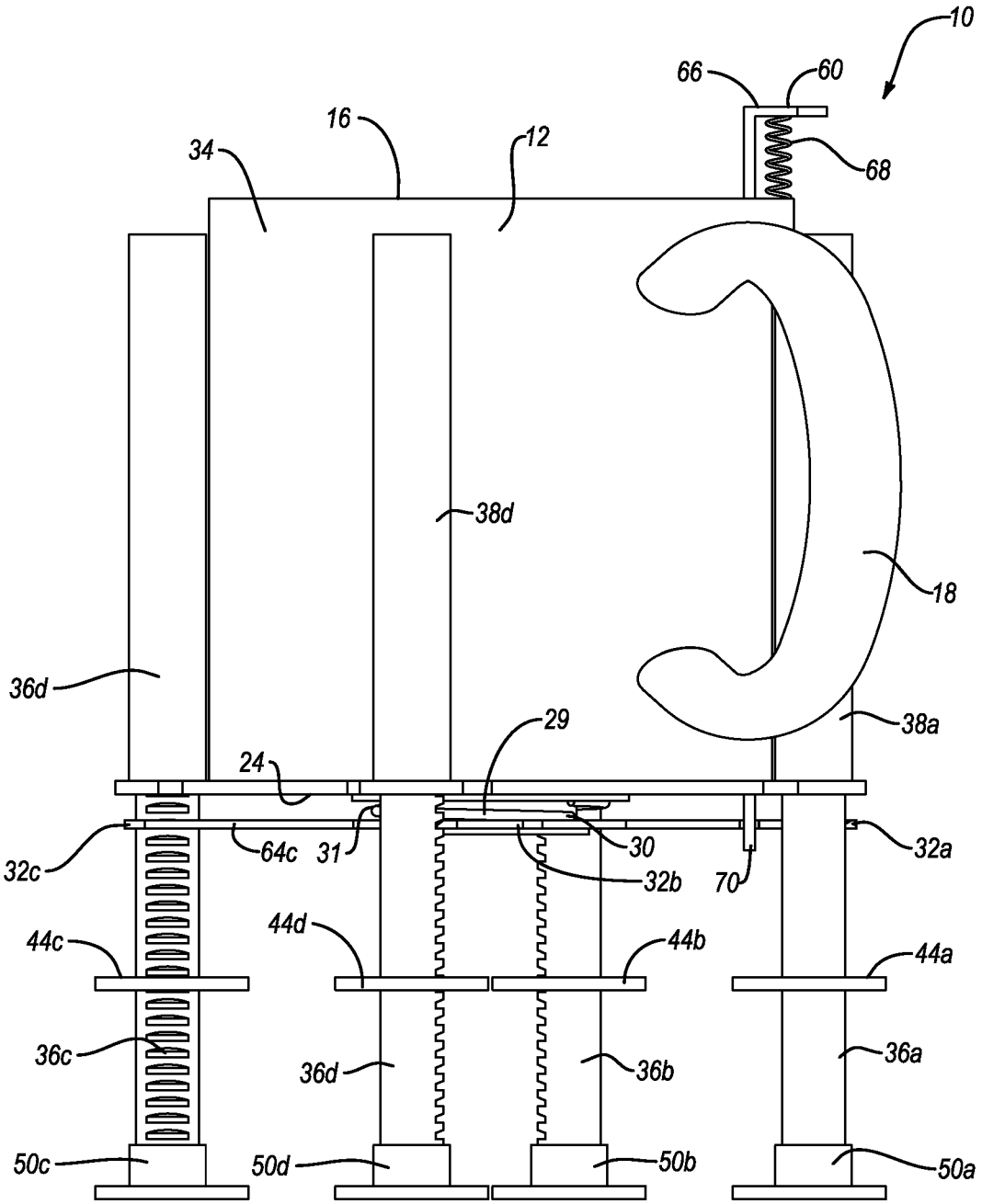
FIG. 4 is a side, three-dimensional view of the first embodiment of the cup stabilization device, in accordance with the present invention.
Figure 5:
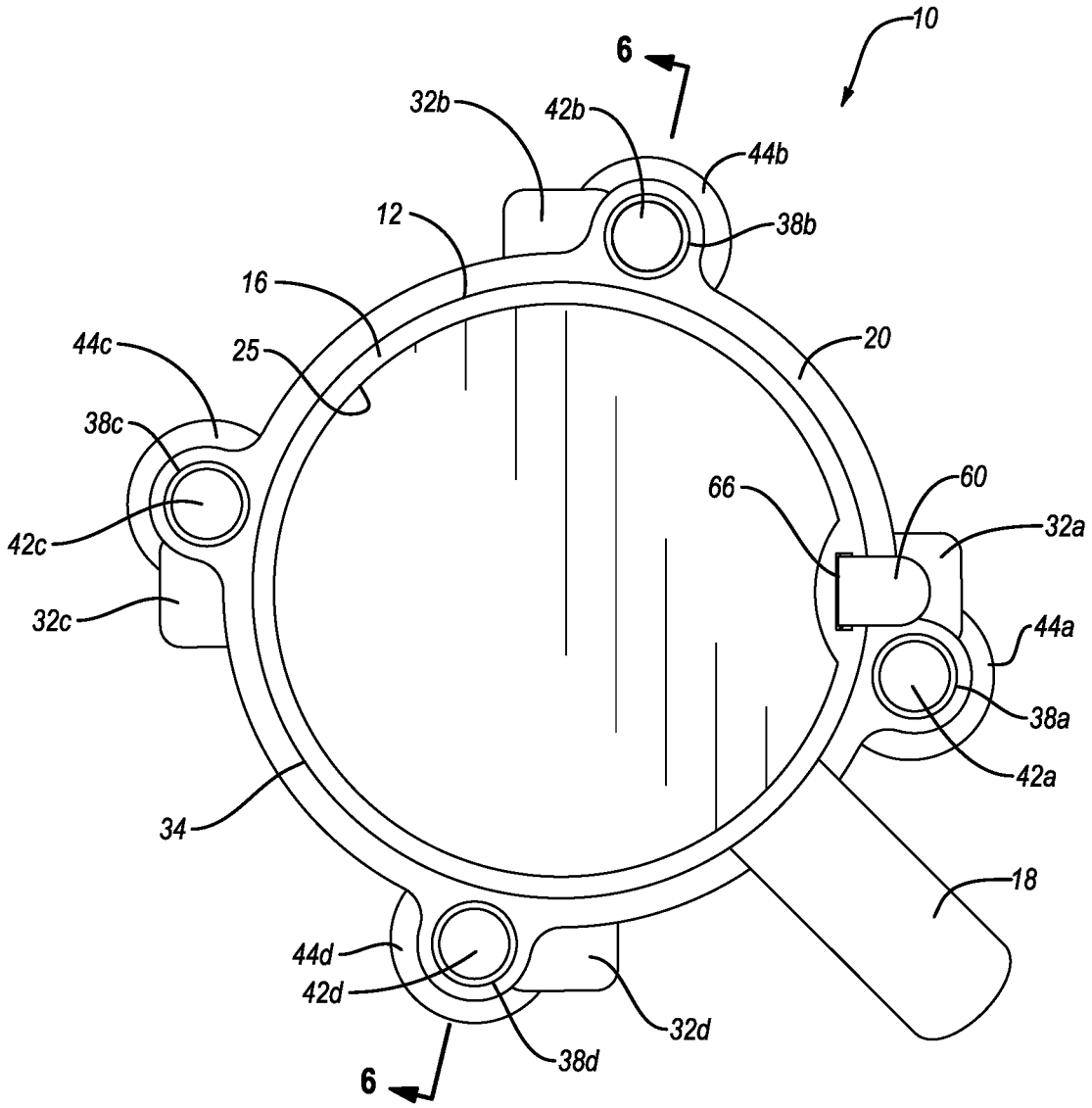
FIG. 5 is a top three-dimensional view of the first embodiment of the cup stabilization device, in accordance with the present invention.
Figure 6:
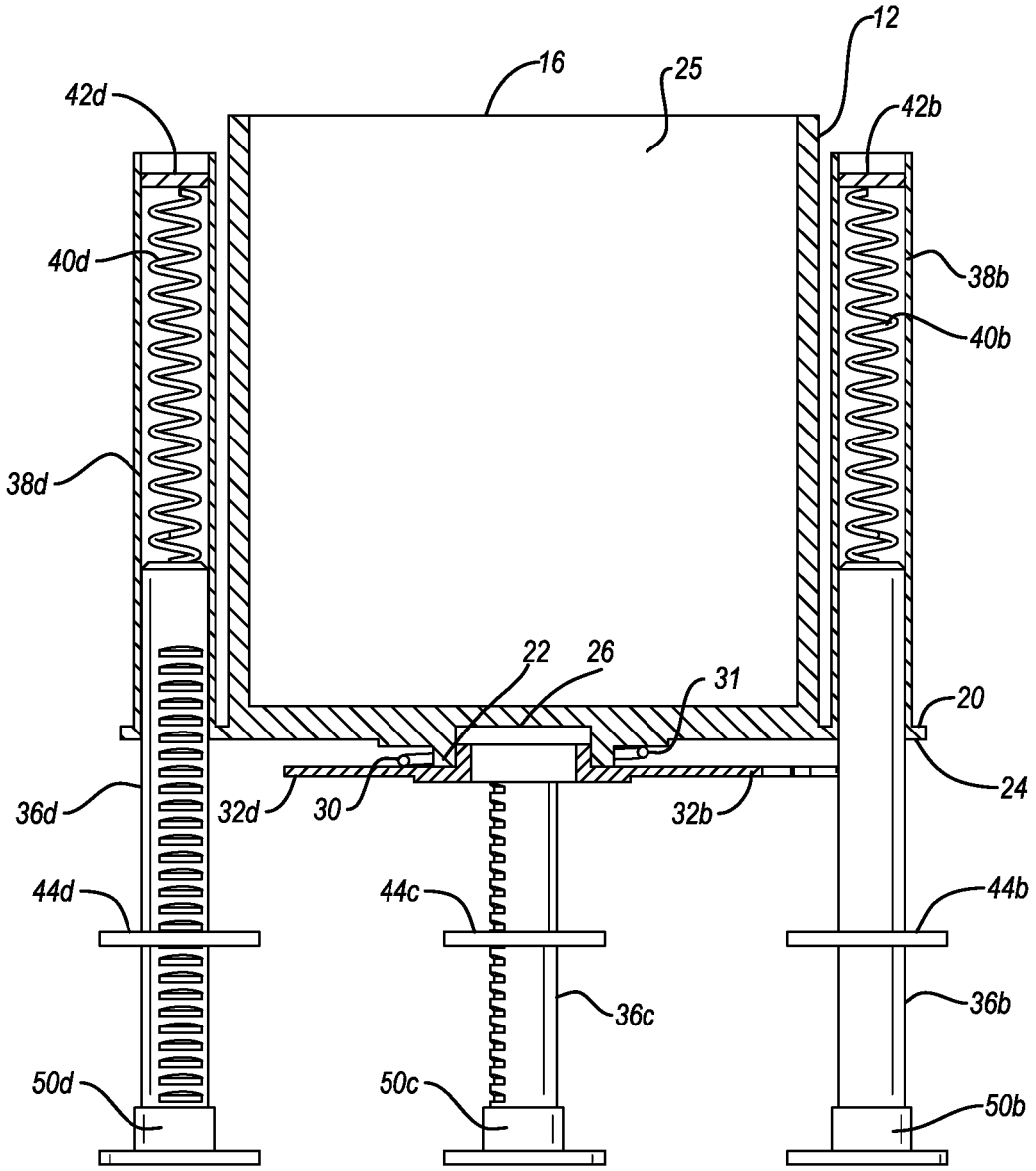
FIG. 6 is a cross-sectional view through 6-6 of FIG. 5 of the cup stabilization device shown in FIG. 5, in accordance with the present invention.

The container 12 can be a cup, as shown in FIG. 1. Alternatively, the container 12 can be a bottle or a glass. The container 12 can be a cup provided with a u-shaped handle or grip 18 projecting out from one side. In that case, a cup, glass, or bottle can be inserted into the open upper end 16 of the cup 12. When the container 12 is a cup as shown in FIG. 1, the cup has a circular base 20. The circular base 20 has a central portion 22 which projects upward from the outer surface 24 of the circular base. The central portion 22 rotates between 0 degrees and 45 degrees with respect to the center 26 of the central portion 22. The central portion 22 extends through the bottom of the circular base 20 into the interior 25 of the container 12. The central portion 22 includes a spring 29, such as a torsion spring 29, as shown in FIG. 3, with one end 30 projecting from one side of the central portion 22 and the opposite end 31 secured to the central portion. The central portion 22 rotates about a centerline 27 extending through the center of the container 22.

The outer surface 24 of the circular base 20 has a circular structure 33 which is mounted to the circular base 20 by the central portion 22. The circular structure 33 can have four projections 32*a*, 32*b*, 32*c*, and 32*d* (32*a*-32*d*) extending out beyond the outer wall 34 of the container 12. A first centerline A-A extends along two opposing projections 32*b* and 32*d*, and a second centerline B-B extends along two opposing projections 32*a* and 32*c*. The first and second centerlines A-A and B-B cross each other at the center of the circular structure 33.

Figure 2A:
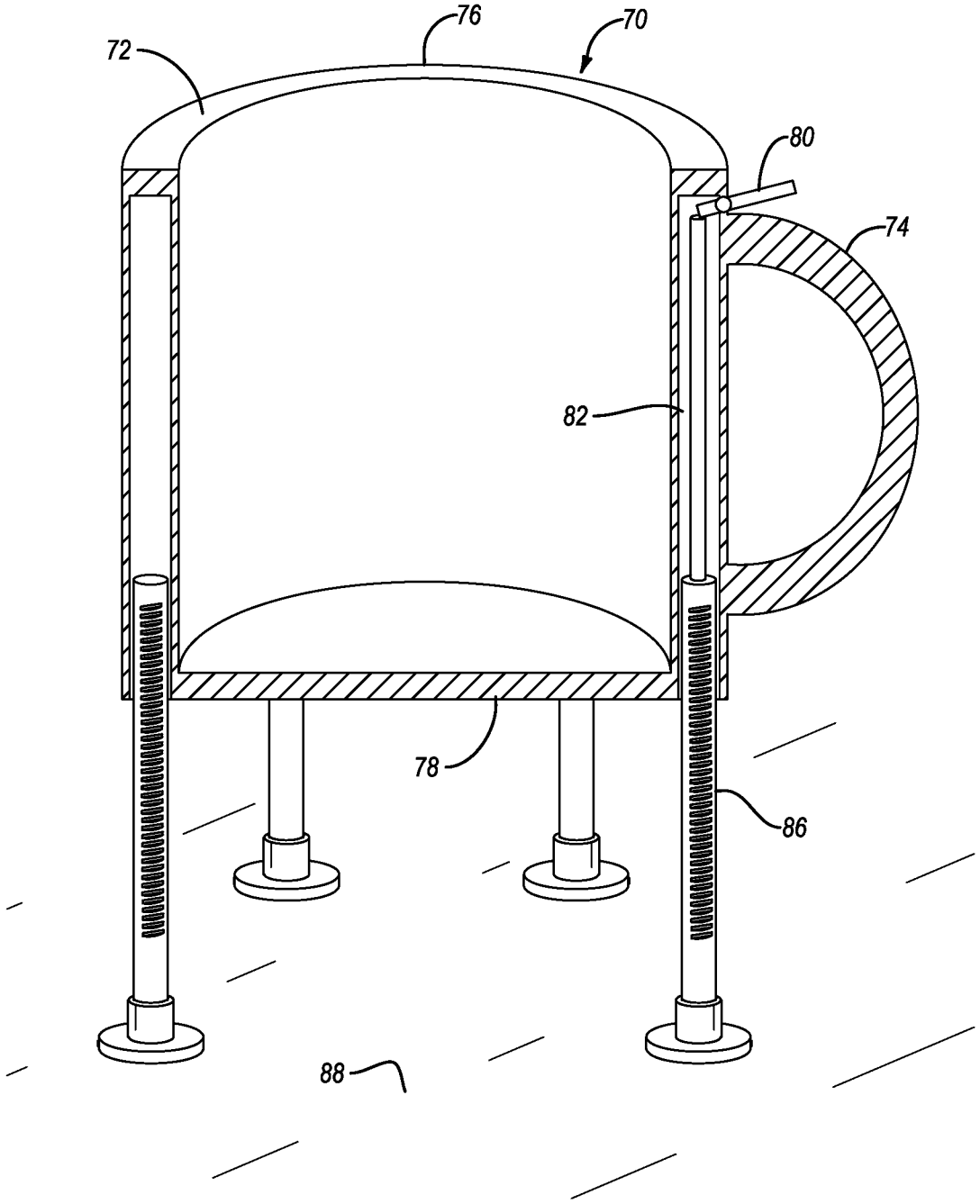
FIG. 2A is a cross-sectional view showing a second embodiment of the cup stabilization device, in accordance with the present invention.
Figure 2B:
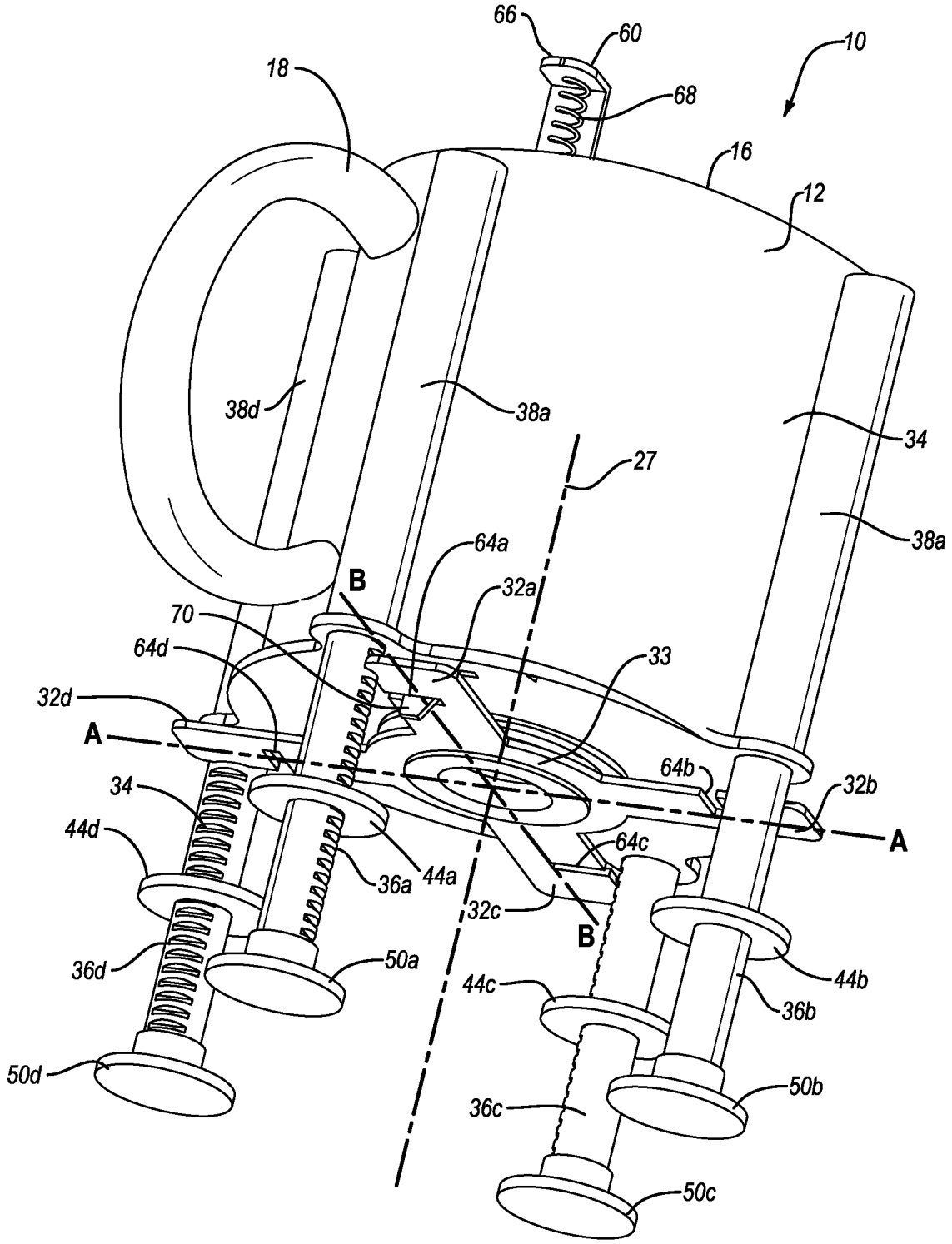
FIG. 2B is a bottom, three-dimensional view of the first embodiment of the cup stabilization device, in accordance with the present invention.

The circular structure 33 can rotate between 0 degrees and 45 degrees with respect to the centerline 27 through the central portion 22 of the cup where the first and second centerlines A-A and B-B cross each other, as shown in FIG. 2B. The four projections 32*a*, 32*b*, 32*c*, and 32*d* engage slits 34*a*, 34*b*, 34*c*,34 *d* (34*a*-34*d*) which are disposed along one side of the four cylindrical pillars 36*a*, 36*b*. 36*c* and 36*d* (36*a*-36*d*). The four cylindrical pillars 36*a*-36*d* are received in hollow cylinders 38*a*, 38*b*, 38*c*, 38*d* (38*a*-38*d*), respectively. The top surface of each of the pillars 36*a*-36*d* engages the lower end of a compression spring 40*a*, 40*b*, 40*c*, and 40*d* (40*a*-40*d*). The upper end of each compression spring 40*a*-40*d* engages a stop 42*a*, 42*b*, 42*c* and 42*d* (42*a*-42*d*) mounted in the upper end of the cylindrical pillars 36*a*-36*d*, respectively.

Each of the pillars 36*a*-36*d* has a foot 50*a*, 50*b*, 50*c*, 50*d* (50*a*-50*d*) secured thereto. The foot prevents the pillar from digging into the ground.

A circular stop 44*a*, 44*b*, 44*c*, and 44*d* (44*a*-44*d*) formed on the lower end of each cylindrical pillar 36*a*-36*d* and acts to engage the outer surface 24 of the circular base 20.

As shown in FIG. 2B, when the device 10 is placed on an uneven surface 14, one of the pillars 36*a* presses against the spring 40*a* to even out the cup so that the liquid in the container 12 is maintained flat or parallel with respect to the surface 14, ie. the ground, on which the stabilization device 10 is supported. In that case, the container 12 will sit at an angle so that the liquid in the container does not spill out from the top 16 of the container. This causes the circular stop 44*a*-44*d* to press against one of the four projections 32*a*-32*d*, causing the central portion 22 to rotate about the centerline 27 against the bias of the spring 29. When the position of the cylindrical pillar is set, the spring causes the circular stop to rotate back into place within a slit 36*a* in the cylindrical pillar 36*a*.

As shown in FIG. 1 and FIG. 2B, lock release 60 extends through a slot 62 through the interior of the container 12 from the open end 16 of the cup through the circular base 20 and one of the projections 32*a*-32*d* when the cup is pressed down to even the top with the surface of the ground 14. This causes the top 66 of the lock release 60 which projects out 90 degrees from the extended length of the lock release to press against the spring 68 while the opposite lower end 70 of the lock release is pressed into the slot 64*a* as shown in FIG. 2B. The result is that the circular structure rotates about the center 26 and releases the circular base.

Referring to FIG. 2B, there is illustrated a second embodiment of the cup stabilization device 70, which includes a cup 72 with a u-shaped handle or grip 74 projecting out from one side. In that case, a cup, glass, or bottle can be inserted into the open, upper end 76 of the cup 72. When the container 72 is a cup as shown in FIG. 2BA, the cup has a circular base 78. The circular base 20 has a central portion (not shown) which operates like the central portion shown in the first embodiment.

The cup stabilization device 70 includes a lock release 80 that extends through a slot 82 through the side of the container 72 from the open end 76 of the cup through the circular base 78. The lock release 80 engages a rod 84 which presses against a spring (not shown) in the projections 86 when the cup is pressed down to even the top surface 76 with the surface of the ground 88. This causes the top of the lock release 80, which projects out from the rod 82, which presses against a spring in the projection 86.

Though the invention has been shown and described with respect to a certain preferred embodiment or embodiments, certain equivalent alterations and modifications will occur to others skilled in the art upon the reading and understanding of this specification and the annexed drawings. In particular, regard to the various functions performed by the above-described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A stabilization device, comprising:

a container configured to contain a liquid;

four cylindrical pillars received in hollow cylinders;

a compression spring in each of the hollow cylinders; and a circular structure;

wherein the container comprises a circular base, and the circular base comprises a central portion that is rotatable between 0 degrees and 45 degrees with respect to a center of the central portion;

wherein the circular structure is mounted to the circular base by the central portion, the circular structure comprises four projections extending out beyond an outer wall of the container engaging slits which are disposed along one side of each of the four cylindrical pillars;

wherein each compression spring is engaged with a corresponding cylindrical pillar, and the central portion comprises a torsion spring;

wherein a top surface of the liquid in the container is maintained flat or parallel with respect to a surface on which the stabilization device is supported.

2. The stabilization device of claim 1, wherein the surface is a ground.

3. The stabilization device of claim 1, wherein the container is a cup.

4. The stabilization device of claim 1, wherein the container is a cup provided with a handle projecting out from one side.

5. The stabilization device of claim 1, wherein the circular base comprises the central portion which projects upward from an outer surface of the circular base.

6. The stabilization device of claim 1, wherein a first end of the torsion spring projects from one side of the central portion, and a second end of the torsion spring is secured to the central portion.

7. The stabilization device of claim 6, wherein the central portion rotates about a centerline of the container.

8. The stabilization device of claim 7, wherein the circular structure has a first centerline and a second centerline, the first centerline extends along a first projection and a second projection of the four projections, the second centerline extends along a third projection and a fourth projection of the four projections, the first projection is opposite to the second projection, and the third projection is opposite to the fourth projection.

9. The stabilization device of claim 8, wherein the circular structure is rotatable between 0 degrees and 45 degrees with respect to the center of the central portion.

10. The stabilization device of claim 9, wherein the first centerline and the second centerline cross each other.

11. The stabilization device of claim 10, wherein a top surface of each of the cylindrical pillars engages a lower end of a corresponding compression spring.

12. The stabilization device of claim 11, wherein an upper end of each compression spring engages a stop mounted in an upper end of each of the cylindrical pillars.

13. The stabilization device of claim 12, wherein a lock release extends through a slot through an interior of the container from an open end of the cup container through the circular base and one of the projections when the cup container is pressed down to even a top of the container with a ground.

14. The stabilization device of claim 12, wherein a lock release extends and projects out 90 degrees from an extended length of the lock release to press against a spring while an opposite lower end of the lock release is pressed into a slot whereby the circular structure rotates and releases the circular base.

* * * * *